United States Patent [19]

Laby

[11] 3,994,330

[45] Nov. 30, 1976

[54] RELEASABLY RESTRAINED FOLDING DOOR FOR SHOWERS AND THE LIKE

[75] Inventor: Jordan M. Laby, Sherman Oaks, Calif.

[73] Assignee: American Shower Door Co., Inc., Santa Monica, Calif.

[22] Filed: June 11, 1975

[21] Appl. No.: 586,073

[52] U.S. Cl. ..... 160/199

[51] Int. Cl.[2] ..... E05D 15/26

[58] Field of Search..... 160/199, 206, 235, 84 R, 160/229; 49/411

[56] References Cited

UNITED STATES PATENTS

| | | | |
|---|---|---|---|
| 2,699,827 | 1/1955 | Carson | 160/229 R |
| 2,885,000 | 5/1959 | Merrill | 160/199 X |
| 3,419,063 | 12/1968 | Mock et al. | 160/199 |
| 3,486,549 | 12/1969 | Rosenquist | 160/199 X |
| 3,516,473 | 6/1970 | Rosenquist | 160/235 X |
| 3,720,255 | 3/1973 | Ueda | 160/199 |

*Primary Examiner*—Philip C. Kannan
*Attorney, Agent, or Firm*—Wm. Jacquet Gribble

[57] ABSTRACT

A plurality of vertical panels have edge slip hinge joint members adapted to unite mirror oriented similar adjacent panels. Each panel has a top clip and a bottom clip. Alternate top clips have swivelled roller pairs which ride on horizontal beams of the door frame header. Bottom panel clips have a guide pin depending into a channel in the bottom track of the door frame. Each panel clip has a platform extending across the top or bottom terminal end of the hinge joint of the joined panel edges. The platforms cooperate to preclude vertical displacement of the panels with respect to one another. Retainers at each of two vertical end rails extend transversely to cooperate with a bottom horizontal restraint rib to limit vertical displacement of the folding door bottom with respect to the door frame. Shaped prongs within each panel clip cooperate with aperture walls at the top and the bottom of each panel to secure the clips thereto and to prevent displacement of the apertured panel from the prongs.

13 Claims, 13 Drawing Figures

RELEASABLY RESTRAINED FOLDING DOOR FOR SHOWERS AND THE LIKE

BACKGROUND OF THE INVENTION

The invention relates to folding or "accordion" doors and more particularly to folding shower and bath cubicle doors suspended on an upper header and guided by a bottom track. The track may be secured to the upper rim of a bathtub or to the receptacle basin of a shower.

The requirements for bath and shower enclosures include relative water-tightness, ease of manipulation, light transmitting capability, resistance to abuse, ease of assembly and economy of fabrication. Prior attempts to accomplish all of these objectives are exemplified by the following U.S. Pat. Nos.: 2,699,827, Carson, Jan. 18, 1955; 3,419,063, Mock, Dec. 31, 1968; 3,516,473, Rosenquist, June 23, 1970.

The within invention accomplishes all of the above objectives by an ingenious combination of elements which not only affords a smoothly folding, enduring closure door, but provides a door which is easily assembled and remains secure within its frame once it is assembled.

SUMMARY OF THE INVENTION

The invention contemplates a folding door for an opening with a frame and comprises a plurality of similar vertical panels with hingedjoinder means on both edges of each panel for articulated union with each adjacent panel. Top and bottom panel clips have snap means securing the clips to the panels, and extending platforms at an end of the clip adapted to preclude relative vertical displacement of adjacent panels at the joinder means to retain panel position. Swiveled roller assemblies attached to alternate top panel clips engage roller beams on the frame header and combine with the clip platforms to movably support the panels. Guide pins extend from bottom panel clips into a bottom track of the door frame, which has a restraint rib extending horizontally along its upper edge. A transverse restraint fixed to each terminal vertical end rail of the folding door is adapted to contact the restraint rib and limit upward displacement of the door bottom within the frame.

Preferably each of the intermediate panels between the terminal vertical rails is identical, having male and female joinder edges, with alternate panels being oriented in mirror fashion with respect to the adjacent panels. Similar joinder edges link the panels and the terminal rails.

In a preferred embodiment the panel clips are U-shaped in cross-section and the means securing the clips to the panels comprises closed perimeter walls near the upper and the lower ends of each panel and relatively resilient protrusions or prongs within each panel clip adapted to snap into the apertures defined by the perimeter walls when the clips are pushed onto the panel ends. Each prong further has a dog or lip adapted to prevent displacement of the panel perimeter walls from the prong when the panels are canted or tilted with respect to the panel clips.

The invention thus provides folding doors for framed openings which operate smoothly, are economical to fabricate and assemble, and can be made from readily obtainable transparent or translucent materials which are not frangible and are therefore safe for panels.

These and other advantages of the invention are apparent from the following detailed description and drawing.

DESCRIPTION OF THE PREFERRED EMBODIMENTS

Figure 1:
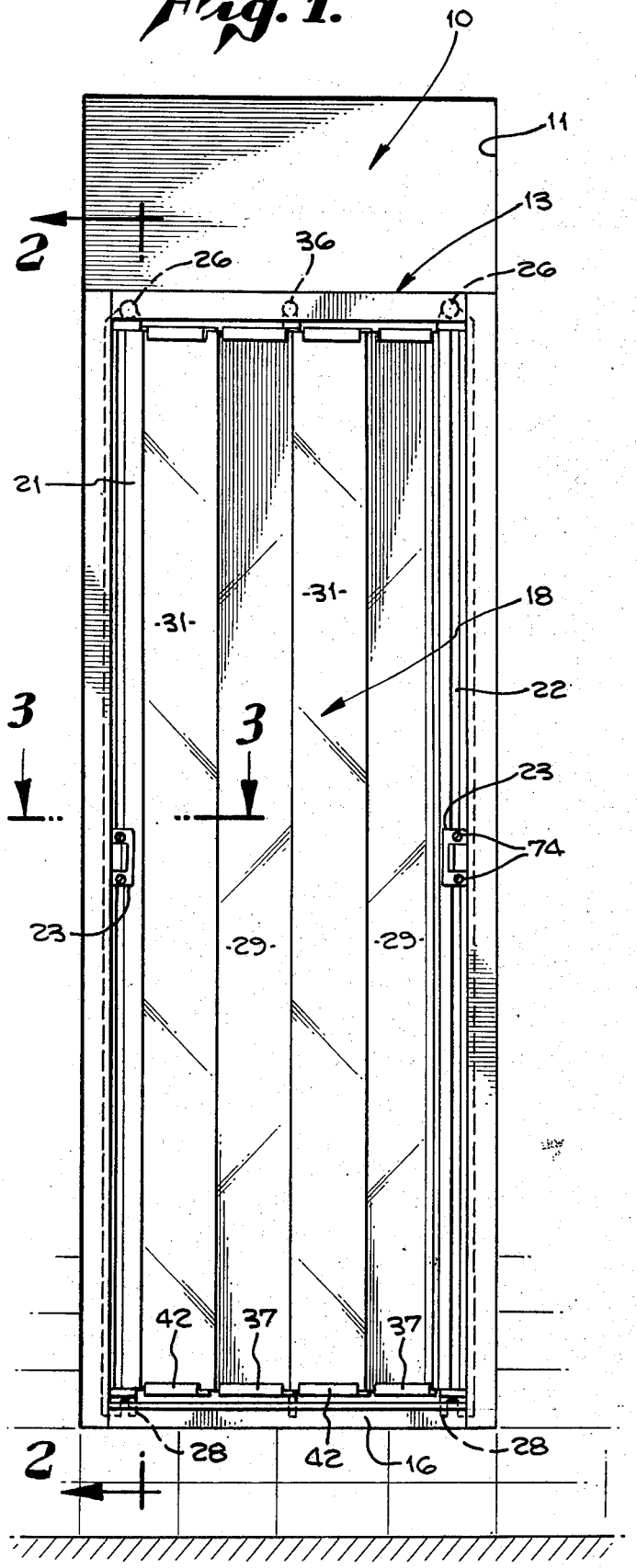
FIG. 1 is a rear elevation of a folding door in place in a shower doorway.

FIG. 1 shows an enclosure, such as a stall shower 10, in which a framed opening 11 contains an inset frame 12 having a header 13, right and left jambs 14, 15 and a bottom track 16. A folding door assembly 18 is mounted in the inserted frame.

Door assembly 18 comprises a left lead rail 21 and a right lead rail 22 to each of which an interior handle 23 is fixed. The interior handle assembly also includes a latching magnet 24 discussed in more detail later on with respect to FIG. 4.

The lead rails are fixed relative to their respective vertical axes, although each is free to move horizontally, suspended by a roller assembly 26 fixed to the top of the lead rail and guided by a depending channel rider 28 in the bottom track. The panels intermediate the lead rails are of two types: a roller panel 29 and a follower panel 31. Unlike the lead rails the panels pivot about vertical hinge lines. The panels are both made from the same extruded material, but are oriented differently with respect to "inside" and "outside" of the cubicle and capped at each end with differing panel clips. For instance, in FIG. 1, roller panels 29 have top clips 34 with supporting swivel roller assemblies 36, and bottom clips 37 with depending guide pins 38. The follower panels 31 have top clips 41 without rollers and pinless bottom clips 42. Follower panels next to the lead rails are supported in part by the rails.

Figure 2:
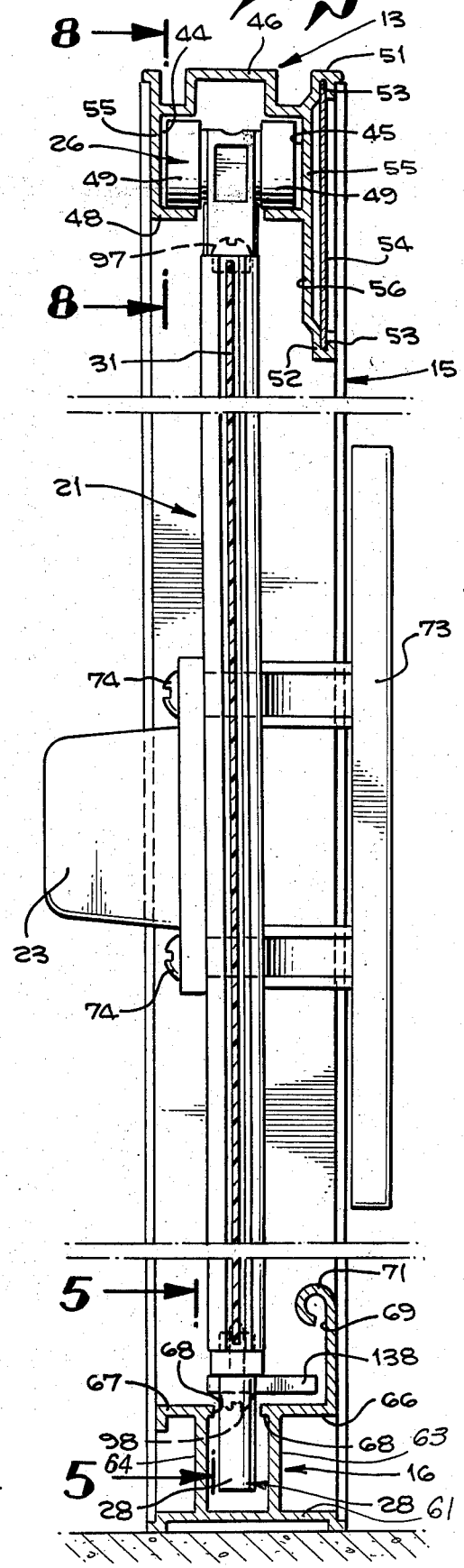
FIG. 2 is a fragmentary sectional elevation taken along line 2 — 2 of FIG. 1.

The cross-sectional shapes of the header 13 and the bottom track 16 are shown in FIG. 2. The header has facing channels 44, 45 connected by an upper yoke 46. Each channel has a bottom beam 48 upon which the rollers 49 of the various roller assemblies ride. The outer face of the header has vertically spaced fascia beads 51, 52 which run the length of the header. Each bead has a groove 53. The two grooves retain a fascia board 54 trimmed exteriorly in keeping with the chosen decor of the shower enclosure.

Each channel has a web 55, the web of the outer channel being extended downwardly at 56 to support lower fascia bead 52. The header fits between jambs 14 and 15 and within the flanges 57, 58 of both jambs.

The bottom track 16 also fits within the jamb flanges and has a base 61 from which risers 63, 64 extend to outward flanges 66, 67. Each flange has an inward lip 68 protruding into the space between risers. The lips act as guides for the channel riders 28 of the lead rails 21, 22 and for the pins 38 of the bottom clips. Additionally, the exterior flange turns upward in a web 69 that terminates in a restraining bead 71 extending the width of track 16.

In addition to the inner handle 23 at each end of the folding door, an outer handle 73 is fastened by screws 74 to each inner handle assembly, affording entrance and egress from either end of the folding door. Since the lead rails stay fixed in the plane of the opening, the attitude of the handles does not vary even though the other panels turn about a vertical hinge line to fold in accordion fashion.

Figures 3, 4, 5, 6:
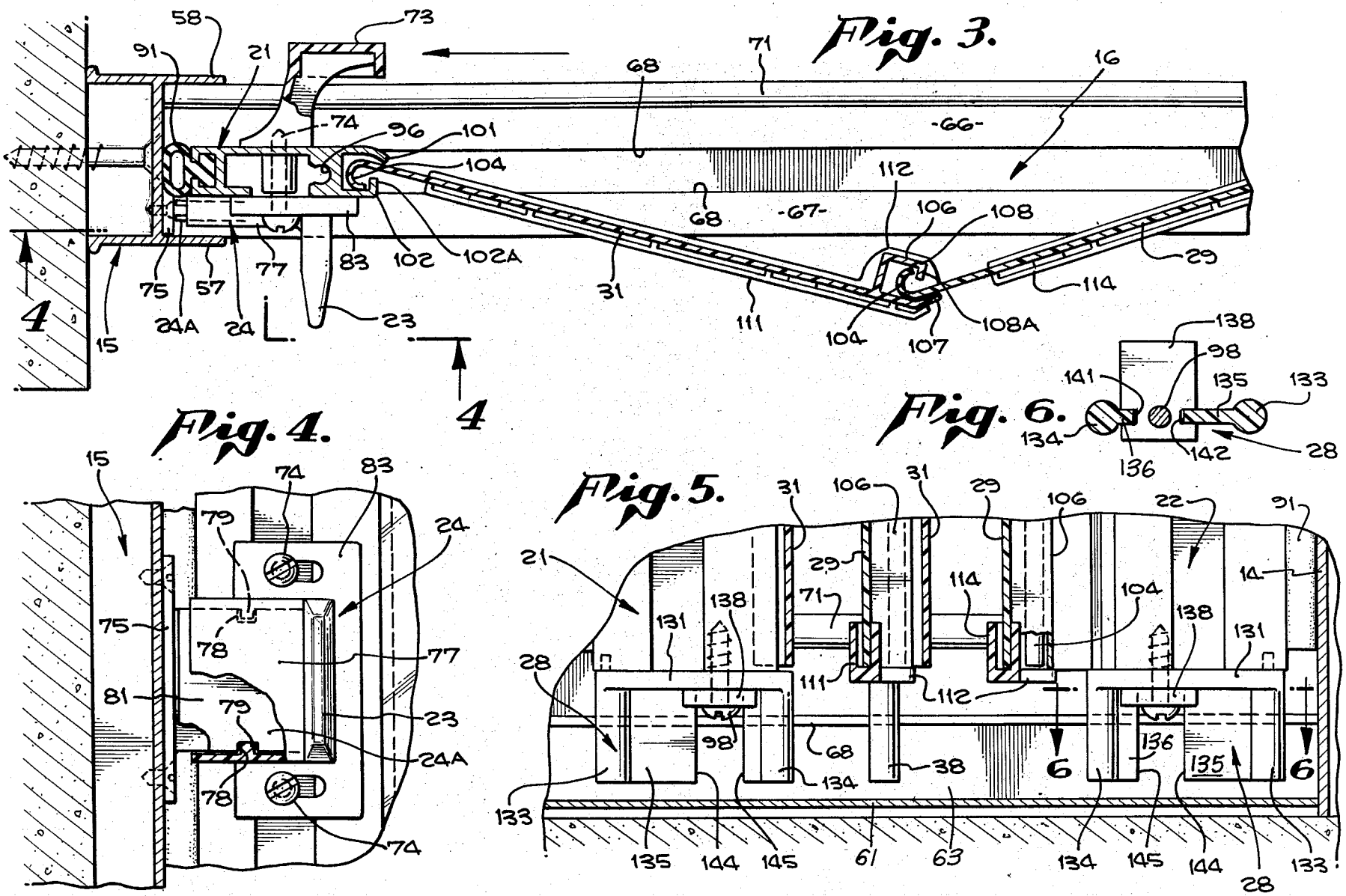
FIG. 3 is a fragmentary plan section taken along line 3 — 3 showing handle and catch details of the door.
FIG. 4 is a fragmentary rear elevation, partly in section, taken along line 4 — 4 of FIG. 3.
FIG. 5 is a fragmentary rear elevation, partly in section, taken along line 5 — 5 of FIG. 2.
FIG. 6 is a fragmentary plan section taken along line 6 — 6 of FIG. 5.

In FIG. 3 folding door assembly 18 is shown closed against jamb 15 with lead rail 21 held in contact by magnetic latch 24. The magnet 24A engages a striker plate 75 secured to the jamb, and operates in the manner set forth in my co-pending patent application Ser. No. 556,676 filed Mar. 10, 1975 and entitled "Magnetic Door Latch."

Similar to the device described in that application, a housing like housing 77 contains a laminar magnet 24 with marginal notches 78 into which housing protrusions 79 fit loosely. Thus, while restrained in the housing, the magnet face 81 has limited freedom to adjust to make planar contact with plate 75 to insure a secure magnetic attachment despite minor variations in door alignment. The magnet housing is preferably integral with inner handle 23 and includes a mounting pad 83 through which attachment screws 74 extend into lead rail 21 and enter two bosses 85 of exterior handle 73 to fasten that handle to the lead rail. The handles and catch are similarly secured at the other edge of the folding door to lead rail 22.

Figure 7:
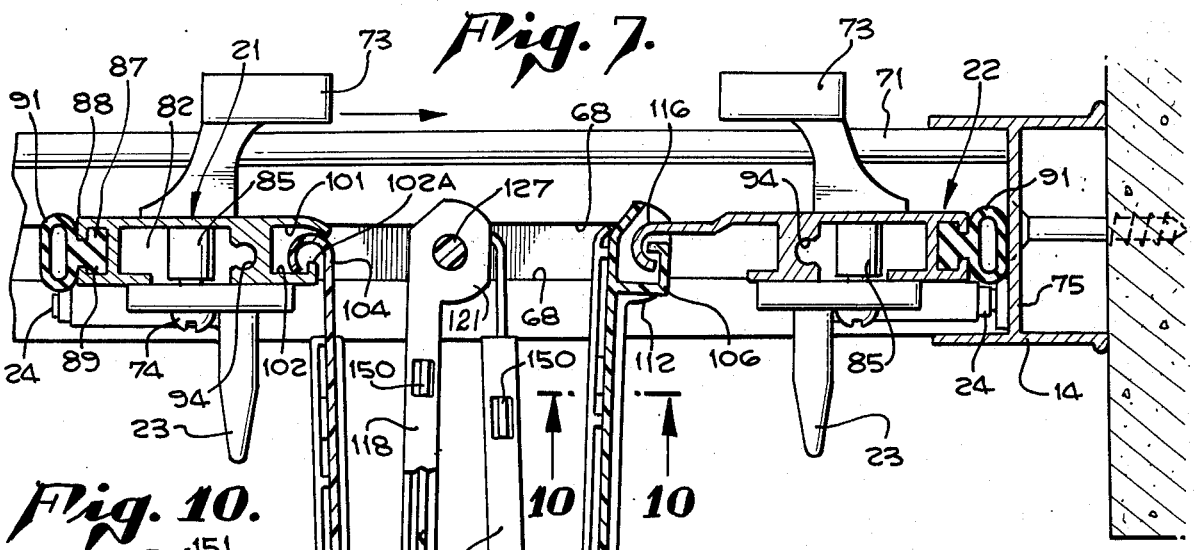
FIG. 7 is a plan view, partly in section, of a folded door in accordance with the invention.

As can be seen from the sectional view of FIG. 7, the right and left lead rails differ somewhat in order to receive the different opposite hinge line edges of the roller and follower panels. Each lead rail may be of an extruded aluminum strip and each has a rectangular vertical cavity 87 with a vertically elongate opening 88 through which an anchor portion 89 of a resilient bumper 91 is inserted into the cavity 87. A larger elongate cavity 92 in each lead rail lessens the weight of each rail and affords space for the bosses 85 of the exterior handles 73. In the cavities 92 remote from the bumper cavity are elongate semicylindrical walls 94 defining continuing cavities 96 in the extruded material from which the lead rail is made. The cavity size is chosen to receive a self-tapping screw such as the screw 97 of FIG. 2 shown in dotted lines securing the roller assembly 26 to the lead rail, and the bottom screw 98 securing the channel rider 28 of the lead rails thereto.

Adjacent to the cavity 92 is a third lead rail cavity which differs between the lead rail 21 and the lead rail 22. Rail 21 is referred to as the female lead rail and has a vertical cavity or channel 99 defined by an extending arcuate wall 101 and an L-shaped opposite wall 102 into which a semicylindrical hinge ledge loop 104 of the follower panel 31 extends. Loop 104 is open and engages a short bar 102A of L-shaped wall 102 to prevent separation of the follower panel from the female lead rail.

The loop 104 extends the vertical length of the follower panel. Opposite hinge edge 105 has a rectangular hinge box 106 extending the vertical length of the panel. The hinge box, like the lead rail 21, has a bent wall 107 and an L-shaped wall 108 with a short bar 108A to engage the open end of loop 104. An elongate web 109 defines the fourth side of the hinge box. The follower panels and the roller panels of folding doors in accordance with the invention are similarly formed from the same extruded shape and then assembled into a door with each adjacent panel oppositely oriented with respect to inside and outside of the door.

In FIG. 3 lead rail 21 and adjacent follower panel 31 are shown linked with a roller panel 29. Like the follower panel, the roller panel has a semicylindrical hinge edge loop 104 fitted into the hinge box 106 on the follower panel. The hinge box short bar 108A engages the open end of a hinge loop 104 of roller panel 29. It can be seen from FIG. 3 that the roller panel is oriented in mirror fashion with respect to the follower panel 31, the loops 104 of each being oppositely oriented with respect to inside and outside of the shower cubicle, but similarly oriented with respect to left and right.

In FIG. 3 a bottom panel clip 111 with a platform 112 underlies the hinge members 106, 104 of panels 31, 29, respectively. A similar bottom panel clip 114 is secured to panel 29 and is shown in fragmentary fashion.

The relationship between the follower and the roller panels is further disclosed with respect to FIG. 7 in which the male lead rail 22 with handles 23 and 73 is shown latched against jamb 14 by the magnetic attraction of magnet 24 to strike plate 75. Female lead rail 21 has been moved rightwardly in FIG. 7 with respect to its position in FIG. 1, causing the panels to fold into close proximity one to another and to shift rightwardly along the header and the bottom track such that an opening exists between the folding door and jamb 15. The hinge member orientation of the door is such that the panels, when folded, protrude into the bath or shower enclosure, and do not interfere with use of the room space enclosing the tub or shower cubicle.

The inside-outside reversal of adjacent panels is evident from FIG. 7, as is the similar right-to-left orientation of the hinge members. It is also evident that lead rail 22 has an open channel 116 as a joinder member with the adjacent panel. Channel 116, extruded in the forming of the lead rail, is commensurate with the hinge loops 104 on the panels. Since the lead rails do not torque about a vertical axis, channel 116 does not change its linear orientation with respect to the header and the bottom track. Rather, the hinge box 106 of the adjacent panel moves with respect to the channel 116. Note that a platform 112 of a bottom clip maintains underlying position beneath the hinge members of adjacent panels, in both the folded position of FIG. 7 and the unfolded or closed position of FIG. 3.

Figure 8:
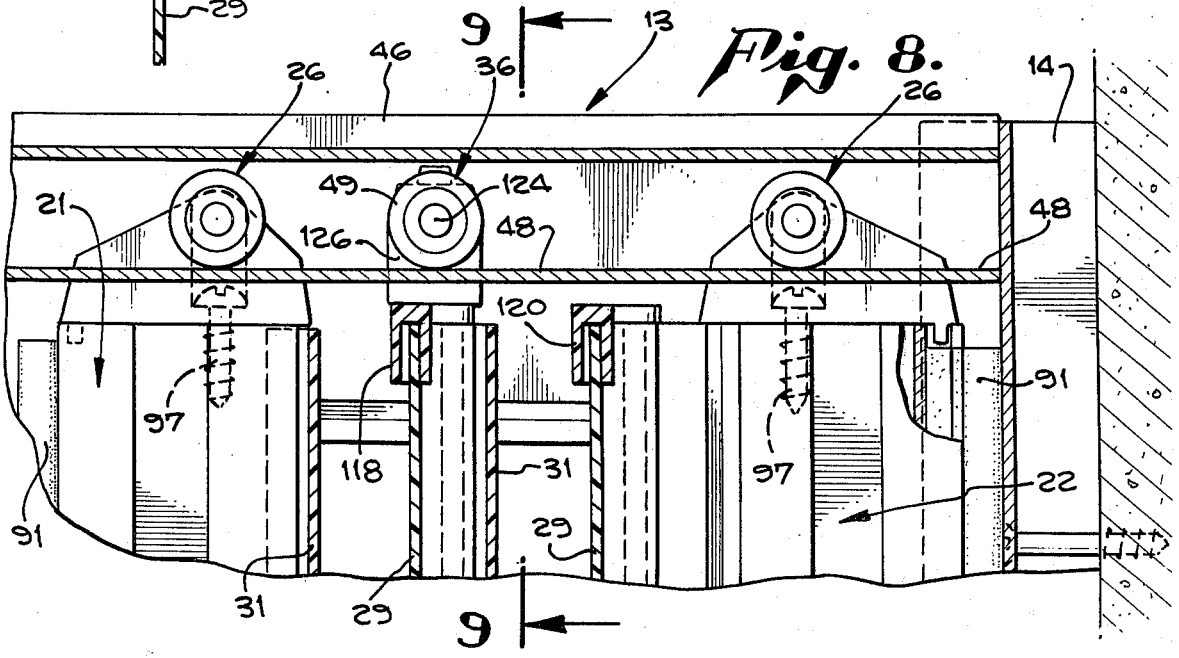
FIG. 8 is a fragmentary rear elevation taken along line 8 — 8 of FIG. 2.

FIG. 7 also shows fragmentarily top panel clips 118 and 119, clip 118 being the top clip for a roller panel and clip 119 being the panel clip for a follower panel. Top clip 118 is seen in FIG. 7 to have an extending platform 121 which overlies the hinge members of adjacent roller and follower panels 29, 31. FIGS. 7, 8 and 9 also illustrate the support roller assembly and the means of securing that assembly to the roller panel. In FIG. 8 the roller assembly 36 is shown riding on beam 48 and projecting above top clip 118 of roller panel 29. Similarly, the roller assemblies 26 of the lead rails are shown on beam 48 and the assemblies 26 are secured to the lead rails by self-tapping screws 97 engaged with the vertical semicylindrical cavities 94, as previously described.

The roller assemblies 36 are differently attached to the roller panel clips. Each assembly has a pair of rollers 49 secured to axles 124 extending from a roller housing 126 through which a clip shank 127 extends. The housing has an inner bore 128 slightly larger in diameter than the clip shank. The shank terminates upwardly in a flared frusto-conical fastening head 129 which is bifurcated. The material of all parts of the roller assembly and of the panel clips is preferably a stiff but resilient light, inert plastic such as Nylon, or Celcon. It is therefore possible to assemble the roller assembly over the clip shank by a downward thrust of the housing 126 onto the bifurcated fastening head causing the head to diminish into the bifurcation and permit the passage of the housing about the shank. Thereafter the head springs outwardly away from the bifurcation and precludes removal of the housing with its attendant rollers.

Each of the transparent or translucent panels 29, 31 is either directly suspended from the beam 48 by a panel clip and roller assembly or by a bottom panel clip platform 112 of a bottom clip on a panel which is roller suspended. As is evident from the FIGS. 3, 5 and 7, clip platforms underlie the downward edges of each hinge joinder of adjacent panels. The panels are thus interdependent as well as joined by loops 104 and 106.

The lead rail guides 28 are seen in detail in FIGS. 5 and 6, a guide 28 being attached to the bottom of each of lead rail 21 and 22 by self-tapping screws 98 engaged in the extruded cavity 96. Each guide has a yoke 131 through which the screw extends. The yoke also unifies depending leading and trailing cylindrical pegs 133, 134 which ride in the track between inward lips 68. A web 135 extends horizontally from each leading peg for strength, as does a rib 136 from each trailing peg. The span of the guides 28 along the bottom track insures no torquing of the lead rails about a vertical axis.

Each lead rail guide also is combined with a transverse restraint 138 which extends beneath restraining bead 71 toward the outer portion of the bottom track. The restraint is apertured to receive screw 98 and notched at 141 and 142 to fit into the space between faces 144, 145 of the guide web and rib, respectively. However, the invention does not preclude transverse restraints integrally formed with the lead rail guides.

Figure 10:
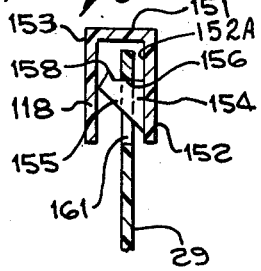
FIG. 10 is a fragmentary sectional elevation taken along line 10 — 10 of FIG. 7, and showing in detail a panel securing prong.
Figure 10:
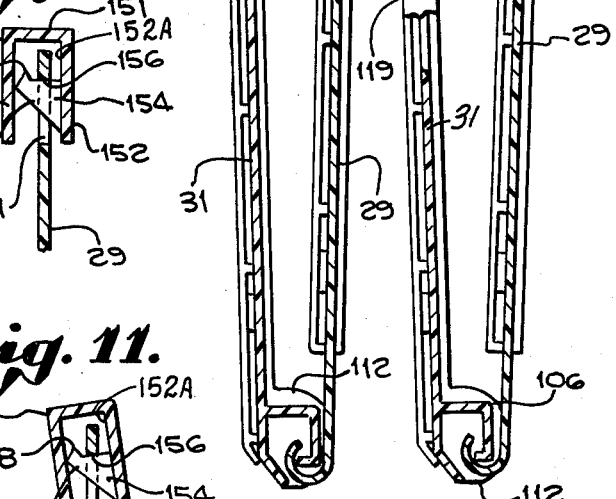
Figure 9:
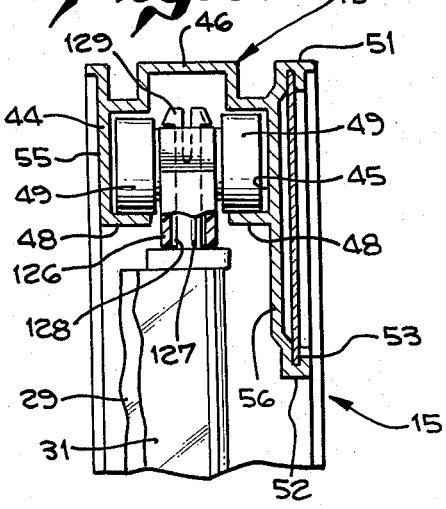
FIG. 9 is a fragmentary transverse sectional elevation taken along line 9 — 9 of FIG. 8.
Figure 11:
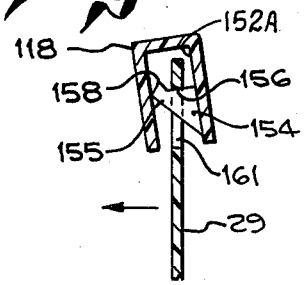
FIG. 11 is a view similar to FIG. 10 with the panel and panel clip skewed with respect to one another.

The follower panels and the roller panels alternate from the lead rails in the door, the number of each depending on the opening width. Each panel has top and bottom panel clips fixed thereto in the fashion shown in FIGS. 10, 11 and 13. In these Figures a roller panel 29 of a translucent material such as polyethylene has a top panel clip 118 of generally U-shaped cross-section. Each panel also has a bottom panel clip 114. A web in each clip joins parallel legs 152, 153 that overlap the edge portion of the panel when attached. The legs are joined by a web 151 which may have openings 150 visible in FIG. 7. At two or more spaced intervals along the clip a triangular prong 154 projects from inner wall 152A of leg 152 toward the other leg 153 of the clip.

Figure 13:
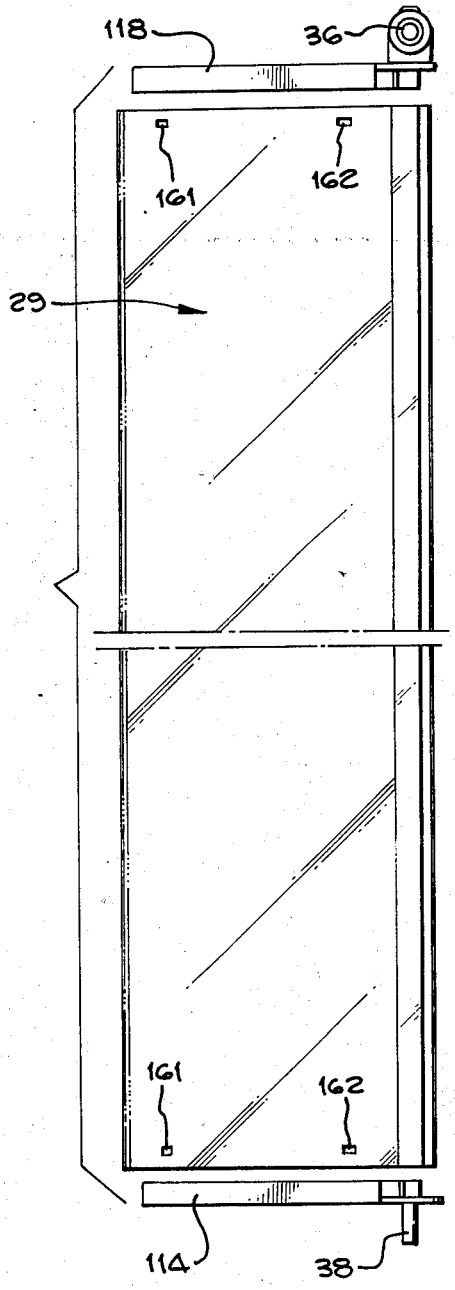
FIG. 13 is an exploded elevational view of a roller panel and top and bottom clips.

Each prong has a ramp 155, a shelf 156 and a retainer tip 158. The prongs are viewable through the die relief holes 150 referred to above. The tip 158 is remote from leg 152, terminating the shelf 156 adjacent the inner wall of leg 153, so that the prong spans most of the space between legs. Since the clips are of a resilient material like Nylon or Celcon, the panels 29, 31 may be joined to a clip by forcing the panel and clip together, the edge of the panel thrusting the legs apart as the panel enters the clip, the panel edge being guided by ramp 155 to the expanded gap between the leg 153 and prong tip 158. Horizontally spaced apertures 161, 162 at the top and the bottom of each panel 29, 31 afford a lock between the panel and the clips as the prongs spring back through the apertures to normal position with tips 158 adjacent each leg 153. The apertures are seen in FIG. 13 horizontally spaced orientation adjacent the panel top and bottom edges.

Figure 12:
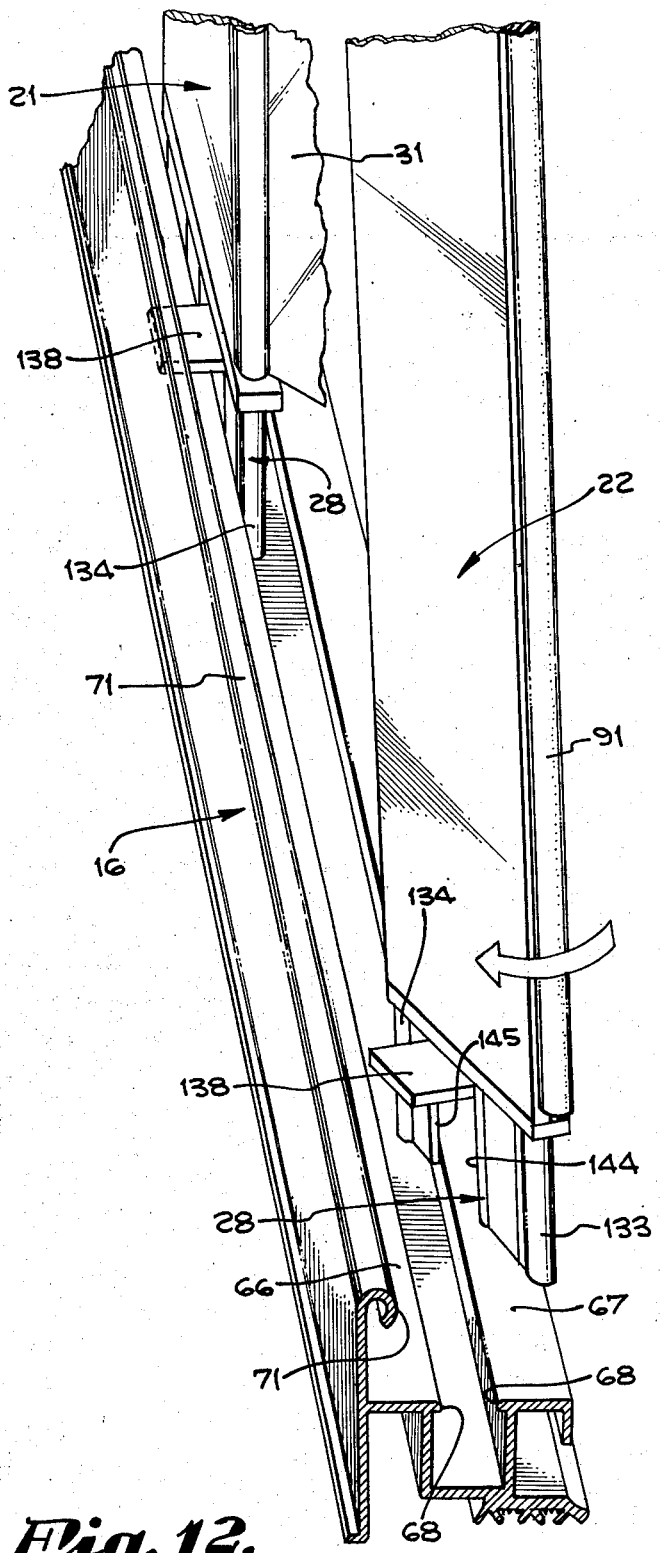
FIG. 12 is a fragmentary perspective view of door assembly.

In some instances, as when the panels and lead rails are being installed in the door frame as shown in FIG. 12, the attitude of the panel to the clip is altered. In the altered position of FIG. 11, for instance, panels of previous folding doors secured by prongs have separated from the clips because of clip distortion which allowed the panel to remove from the shelf of the prong. Such a separation of clip and panel is precluded in applicant's structure by the retainer tips on each prong, which are at a different angle than the shelf and therefore accommodate rack and tilt between the panel clips and the panels.

The assembly of the folding door of the invention is simply accomplished even though the assembled structure is securely held in the framed doorway. The rollers and guides and pins are fixed to the panels and the lead rails, to the panels by means of the panel clips which also unify the folding portions of the door. The rollers are then guided successively onto the header 13 so that the rollers rest on the beams 48 of the header. The header is then joined to the jambs 14, 15 with the folding door panel bottoms suspended inside the enclosure. The panels and a lead rail are then tilted from the vertical along the plane of closure to foreshorten the projection of the guide and guide pins below the bottom track. The bottom guides and pins are then canted into the track, and the transverse restraint inserted beneath the bead 71, and the panels then straightened. The same procedure is followed at the other side of the suspended folding door and the panels and rails are secured removably at the bottom in the track while movably suspended from the header.

The magnet latches or catches may then be engaged with the jamb latch plates to hold the door closed at one or both ends.

It is thus apparent that the invention affords a neat, secure folding door which is easily manipulated, durable and attractive, at a reasonable cost because of its fabrication efficiency. The invention is adaptable to closures of any width and height, since more or fewer panels may be joined between lead rails, while the extruded material for both lead rails and panels may be cut as desired to any length.

While the above sets forth the preferred mode of the invention, many modifications within the scope of the invention will occur to those skilled in this art. It is therefore desired that the disclosure herein be regarded as illustrative only, and the invention be measured rather by the appended claims to invention.

I claim:

1. A folding door for a framed opening having a header and a bottom track and comprising a plurality of terminal and intermediate vertical members, joinder means on a vertical edge of each member for articulate union with each adjacent vertical member, roller support beams on the header, a guide channel on the bottom track, a panel clip at the top and the bottom of intermediate vertical members, securing means on each intermediate vertical member, resilient prongs on each clip adapted to join with the member securing means to retain said clips on said members; an extending platform at one end of each panel clip lying across the joinder means of its attached member and adjacent member to preclude vertical displacement of said members with respect to one another; a roller assembly on an intermediate vertical member, a roller assembly on each terminal vertical member, said roller assemblies being movable on said roller support beams, a guide extending from each terminal vertical member and from an intermediate vertical member to ride in the guide channel of the bottom track; a horizontally extending restraint bead on the frame bottom the length of the bottom track and between the track and the header exteriorly of the folding perimeter of the door, and restraint members fixed to the vertical members restraining vertical motion of the assembled vertical members within limits set by the restraint bead.

2. A folding door in accordance with claim 1 wherein each terminal member is fixed about its vertical axis.

3. A folding door in accordance with claim 1 wherein each intermediate member turns about a vertical axis coinciding with the axis of articulation of the joinder means thereof.

4. A folding door in accordance with claim 3 wherein each intermediate member is a light transmitting panel.

5. A folding door in accordance with claim 3 wherein each intermediate member is similar in configuration to other intermediate members and is differently oriented with respect to adjacent vertical members.

6. A folding door in accordance with claim 1 wherein the securing means on each intermediate vertical member comprises a closed perimeter wall defining an aperture adjacent each of the top and bottom edges of the member, said resilient projecting prong on each panel clip adapted to engage the perimeter wall.

7. A folding door in accordance with claim 6 wherein each prong comprises a projecting surface supporting the perimeter wall and a barrier surface extending above the projecting surface.

8. A folding door in accordance with claim 1 wherein each panel clip comprises spaced parallel horizontal walls, a connector wall between the parallel walls, at least one projecting prong extending from a parallel wall toward the opposite wall, said prong having a horizontal support surface, a vertical barrier surface, and a sloping ramp extending from each of said surfaces converging toward the opposite parallel wall.

9. A folding door in accordance with claim 1 wherein the restraint member fixed to a vertical member is fixed to a terminal vertical member and extends transversely of the bottom track between the guide channel and the restraint bead.

10. A folding door for a framed opening having a header and a bottom track and comprising a plurality of similar vertical panels, joinder means on the vertical edge of each panel for articulated union with each adjacent panel, roller support beams on the header, a guide channel on the bottom track, a panel clip at the top and at the bottom of each panel, each clip being separate from each other clip, securing means at the top and the bottom of each panel, a pair of spaced walls on each clip parallel to the panel end, resilient prongs extending from a clip wall toward an opposite wall of each panel clip, said prongs being adapted to join with the panel securing means to retain the panel clips at top and bottom of each panel, an extending platform at one end of each panel clip lying across the joinder means of its attached and adjacent panels to preclude vertical displacement of said attached and adjacent panels with respect to one another, terminal rails articulately joined to each extreme panel of the door, a roller assembly extending from a panel clip at the panel top and from each terminal rail and adapted to move on the roller support beams, a guide extending from each terminal rail and from the bottom panel clip to ride in the guide channel, a horizontally extending restraint rib on the frame bottom track removed from the guide channel, and transverse restraint members fixed to the rails restraining vertical motion of the assembled panels in the frame within limits set by the restraint rib.

11. A folding door in accordance with claim 10 wherein at least one top panel clip comprises spaced parallel walls, a connector wall between the parallel walls, a platform extending from one end of the connector wall, a prong projecting from a parallel wall toward the opposite wall, a post rising from the platform, a frusto-conical flare at the free end of the post, and spaced walls defining a bifurcation extending centrally through the flare about the axis of the frusto-conical flare and further about the axis of the post.

12. A folding door in accordance with claim 11 further comprising a roller assembly housing, a transverse axle extending from the housing, a cylindrical wall defining a central bore in the housing, and rollers on the axle, said bore having a diameter greater than the diameter of the post and less than the greatest diameter of the frusto-conical flare.

13. A folding door in accordance with claim 10 wherein the guide on each terminal rail comprises a pair of blades fixed with respect to each other and separated along the extent of the guide channel, and wherein each guide on a panel comprises a single cylindrical pin.

* * * * *